US006889477B1

(12) United States Patent
Kottman

(10) Patent No.: US 6,889,477 B1
(45) Date of Patent: May 10, 2005

(54) MODULAR WALL PANEL CONSTRUCTION

(75) Inventor: Mark A. Kottman, Muscatine, IA (US)

(73) Assignee: HNI Technologies Inc., Muscatine, IA (US)

( * ) Notice: Subject to any disclaimer, the term of this patent is extended or adjusted under 35 U.S.C. 154(b) by 422 days.

(21) Appl. No.: 09/684,462

(22) Filed: Oct. 6, 2000

(51) Int. Cl.[7] ..... E04H 4/04

(52) U.S. Cl. ..... 52/238.1; 52/36.1; 52/64; 160/351

(58) Field of Search ..... 52/238.1, 239, 52/242, 220.7, 481–482; 160/135, 351

(56) References Cited

U.S. PATENT DOCUMENTS

| | | | | | |
|---|---|---|---|---|---|
| 4,103,463 | A | | 8/1978 | Dixon | |
| 4,120,124 | A | | 10/1978 | Temple et al. | |
| 4,397,124 | A | | 8/1983 | Redman | |
| 4,555,880 | A | | 12/1985 | Gzym et al. | |
| 4,685,255 | A | | 8/1987 | Kelley | |
| 4,905,428 | A | * | 3/1990 | Sykes | 52/126.4 |
| 5,024,030 | A | * | 6/1991 | Morrison | 211/189 |
| 5,069,418 | A | | 12/1991 | Jennings | |
| 5,381,994 | A | * | 1/1995 | Welch | 248/346 |
| 5,899,036 | A | * | 5/1999 | Seiber et al. | 52/241 |
| 5,901,512 | A | * | 5/1999 | Bullwinkle | 52/220.7 |
| 6,128,877 | A | * | 10/2000 | Goodman et al. | 52/242 |

FOREIGN PATENT DOCUMENTS

| | | |
|---|---|---|
| GB | 543150 | 8/1940 |
| JP | 462259 A | 2/1992 |
| JP | 4169635 A | 6/1992 |

* cited by examiner

*Primary Examiner*—Carl D. Friedman
*Assistant Examiner*—Yvonne M. Horton
(74) *Attorney, Agent, or Firm*—Joseph H. Golant; Jones Day

(57) ABSTRACT

A modular wall panel assembly includes a generally rectangular preassembled frame having a generally horizontal lower channel member and a base rail secured to the lower channel member in parallel spaced relation thereto. Two opposed floor glide assemblies are secured to the base rail and each includes an upwardly directed threaded stem configured at their upper ends to be rotated by a suitable rotary tool. An aperture is provided in the lower channel member in registry with each stem. The frame can thus be leveled on a floor by inserting a rotary tool vertically through the apertures and rotating the threaded stems as desired. Thereafter, decorative or other panels may be conveniently installed on the frame to substantially conceal the floor glides.

19 Claims, 3 Drawing Sheets

MODULAR WALL PANEL CONSTRUCTION

BACKGROUND OF THE INVENTION

1. Field of the Invention

The present invention relates generally to a method and apparatus for installing modular wall panels of the type used in office environments and, more particularly, to a method and apparatus for quickly and conveniently leveling modular wall panels during installation.

2. Description of the Related Art

Modular wall panel systems have become increasingly popular as a means for dividing space in modern offices. Such systems offer the advantage that space can be conveniently reconfigured as the needs of the office environment change. They can be added to, changed in space dimensions and moved with relatively little manual labor and office disruption as compared to permanent partition construction. An example of a modular wall panel system is disclosed in U.S. Pat. No. 4,685,255 issued to Kelley. A typical modular wall panel comprises a metal frame to which one or more decorative panels are attached. The decorative panels are often fabric covered to lend a pleasing aesthetic appearance to the system. The panels may also be provided with internal cable routing means for convenient connection of telecommunications and/or electrically operated equipment. Also typical of the panels is that the frames are provided with means for supporting shelving, cabinets and work surfaces or the like.

In the installation of a modular wall panel system, care must be taken to level the individual panels on the supporting floor surface in order to properly align the vertical edges of the panels so they can be connected together as a unit. To this end, most modular wall panels are equipped with vertically adjustable floor glides, usually one each on opposite sides of the panels along the bottom of the panel. However, a problem encountered with known floor glides as used on modular wall panels is that they are difficult to access for adjustability. Typically, the usual floor glide has a threaded stem which is adjustable using a wrench from beneath the panel and is slow to adjust because the wrench can be moved only through a small range of stem rotation at a time. Often the stem is obscured from view and the installer must rotate the stem by manual feel alone. Modular wall panel systems exist in which the panels are leveled while the leveling means is easily accessible such as from top access. An example of such a system is disclosed in U.S. Pat. No. 4,120,124 issued to Temple et al. and assigned to the assignee herein. However, in such a system the framework of the panel must essentially be assembled in individual pieces making the panel system time consuming to construct on site.

It is therefore desirable to provide a modular panel system that requires only minimal assembly at the site thus reducing labor necessary for installation. It is further desirable to provide such a panel system which is constructed with floor glides that are easily adjusted such that an assembly of panels can be readily leveled on a supporting floor surface to evenly distribute the load across the individual panels. Still further it is desirable to provide such a panel system that is manufacturable by conventional techniques, is aesthetical pleasing in appearance and is cost-effective to produce.

SUMMARY OF THE INVENTION

The present invention improves over the prior art by providing a modular wall panel assembly including a generally rectangular preassembled frame having a generally horizontal lower channel member and a base rail secured to the lower channel member in parallel spaced relation thereto. Two opposed floor glide assemblies are secured to the base rail and each includes an upwardly directed threaded stem configured at their upper ends to be rotated by a suitable rotary tool. An aperture is provided in the lower channel member in registry with each stem. The frame can thus be leveled on a floor by inserting a rotary tool vertically through the apertures and rotating the threaded stems as desired. Thereafter, decorative or other panels may be conveniently installed on the frame to substantially conceal the floor glides.

BRIEF DESCRIPTION OF THE DRAWINGS

The foregoing and other novel features and advantages of the invention will be better understood upon a reading of the following detailed description taken in conjunction with the accompanying drawings wherein.

DETAILED DESCRIPTION OF THE PREFERRED EMBODIMENT

Figure 1:
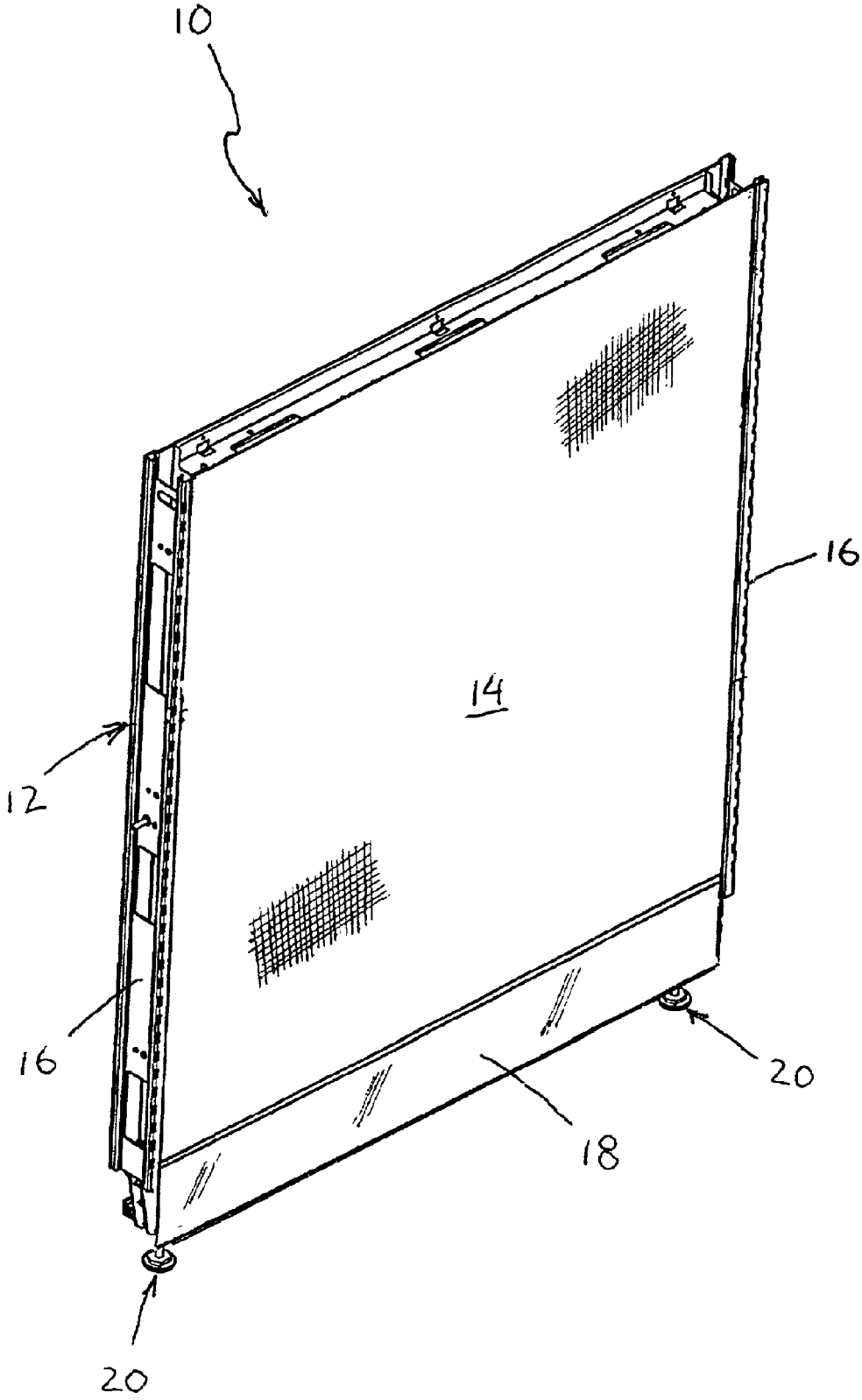
FIG. 1 is a front perspective view of an assembled modular wall panel constructed in accordance with the principles of the invention.
Figure 2:
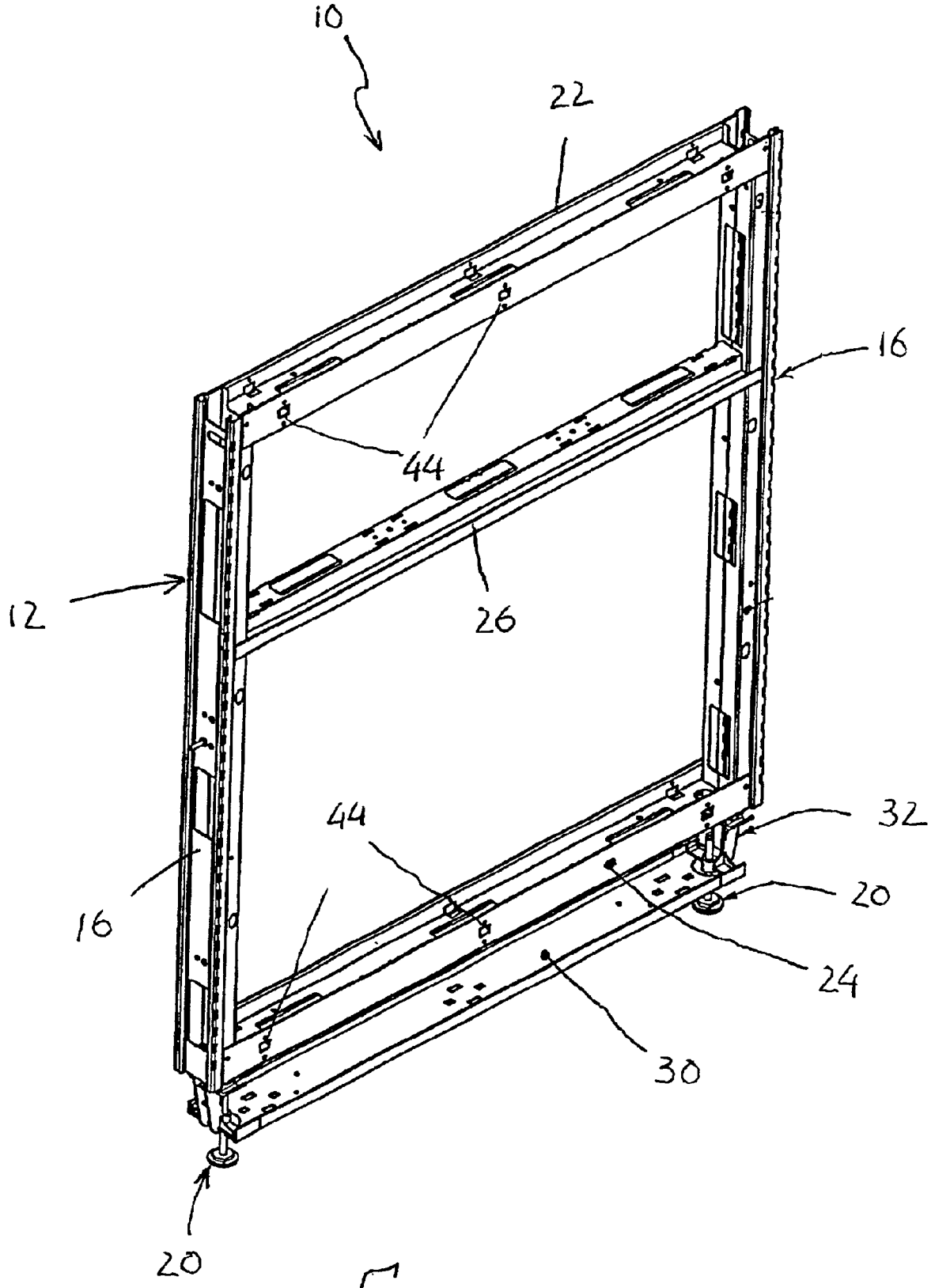
FIG. 2 is a front perspective view of the wall panel assembly illustrated in FIG. 1 shown with its decorative panels or tiles removed.

Referring now to the drawing, and initially to FIG. 1, a modular wall panel assembly is designated generally by the reference numeral 10 and includes as its principal components a generally rectangular preassembled frame 12, which will more readily be seen in detail in FIG. 2, to which an upper decorative panel 14 has been detachably secured. In a manner well-known in the art the panel 14 may be fabric covered with any desirable material for sound deadening and aesthetic appearance. The modular panel 10 is constructed as to be readily connected along side rails 16 to other similar panels to create a system of space dividing partitions suitable for an office environment. Along the bottom of the panel 10 a kick plate 18 may be detachably secured to the frame 12. A pair of floor glides 20 project downwardly from the panel 10 beneath the kick plate 18 as will be described in detail hereinafter.

Turning now to FIG. 2, the panel 10 is illustrated with the decorative panel 14 and kick plate 18 removed showing in detail the construction of the frame 12. The side rails 16 are connected to an upper channel member 22 and a lower channel member 24 as by welding, for example. An intermediate channel member 26 may be provided for strength and also to support various electrical or telecommunications devices internal to the panel 10. The assembly 10 also includes a base rail 30.

Figure 3:
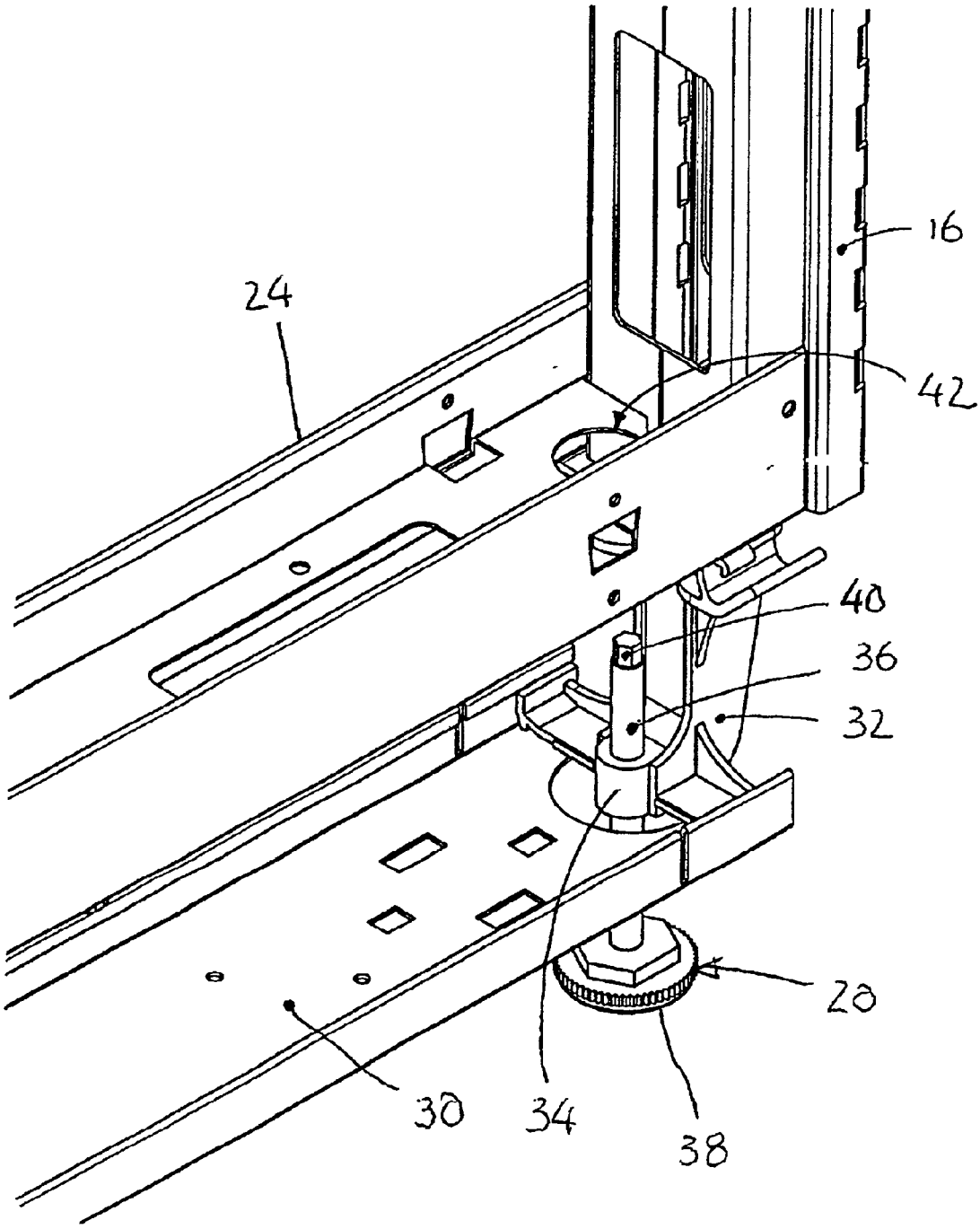
FIG. 3 is an enlarged fractional perspective view of the bottom right corner of the panel assembly illustrated in FIG. 2.

Referring to FIG. 3, the bottom right corner of the assembly 10 shown in FIG. 2 is illustrated in enlarged perspective. In this view, which is a mirror image of the opposite left-hand corner, the base rail 30 can be seen to be connected by a generally L-shaped glide tower 32 to the lower channel member 24. The glide tower 32 has an internally threaded portion 34 which threadedly receives a threaded stem 36 of a floor glide 20. The bottom end of each floor glide 20 is provided with a foot pad 38. Upper ends 40 of the stems 36 are configured in the illustrated embodiment with a hex head. Alternatively, the upper ends 40 of the stems 36 may be provided with screw driver slots or Torx recesses. An aperture 42 is formed in the lower channel member 24 in registry with each upper end 40 of the stems 36.

Installation of a modular panel system utilizing the panels of the present invention can now be appreciated to be a convenient and labor saving process over installation of prior art systems. The panel assemblies illustrated in FIG. 2 can be preassembled as modular units at a factory for example and conveniently shipped to the installation site. The assemblies may be placed upright on a floor at their approximate intended location. An installer may then level the assemblies such as by placing a carpenter's level on the lower channel member 24 and adjusting the height of the floor glides 20 using a ratchet wrench or cordless drill having a bit inserted vertically through the apertures 42 of the channel member 24. Once the assemblies are leveled the decorative panels 14 and kick plate 18 may be installed. For this purpose the frame 12 may preferably be provided with spaced apertures 44 which receive snap-fit fasteners suitably attached to the backs of the panels 14 and kick plates 18. Thus, the panel system using the present panels 10 is convenient and quick to install.

While the present invention has been described in connection with a preferred embodiment thereof, it will be apparent to those skilled in the art that many changes and modifications may be made without departing from the true spirit and scope of the present invention. Accordingly, it is intended by the appended claims to cover all such changes and modifications as come within the spirit and scope of the invention.

What is claimed is:

1. A method for constructing and installing a modular wall panel assembly comprising the steps of:

forming a generally rectangular frame comprising rigid channel members including a lower generally horizontal channel member;

providing a base rail and securing said base rail to said lower channel member in spaced parallel relation thereto;

providing a pair of glide assemblies on opposite ends of said base rail, said glide assemblies each including a generally vertically oriented threaded member threadedly connected to said glide assemblies;

providing a pair of apertures in said lower channel member each aperture overlying a threaded member and having an axis aligned with a longitudinal axis of said threaded member;

placing said frame, base rail and glide assemblies in vertical orientation on a floor;

inserting a rotary tool vertically through said apertures to engage said threaded members; and rotating said threaded members selectively to thereby level said frame on said floor.

2. The method of claim 1 including the step of attaching decorative panel members to said frame after said frame has been leveled.

3. The method of claim 1 including the step of attaching a base panel member to said lower channel member and base rail to conceal said glide assemblies.

4. A modular panel assembly comprising:

a wall frame including a generally horizontal lower member;

a base rail beneath said lower member;

a connector attached to said base rail and to said lower member wherein said frame is supported by said connector above said base rail, said connector including a threaded sleeve positioned between said base rail and said lower member;

an adjustment member for supporting said wall frame and said base rail, said adjustment member having a threaded stem for engaging said threaded sleeve of said connector, and said threaded stem including a tool receiving upper end portion disposed between said base rail and said lower member; and a tool receiving aperture in said lower member aligned vertically above said tool receiving upper end portion of said threaded stem of said adjustment member, said aperture and said threaded stem having parallel axes.

5. The wall panel assembly of claim 4 including decorative panel members secured to said frame.

6. The wall panel assembly of claim 4 including a base panel member secured to said lower member of said frame.

7. A method for vertically adjusting a modular wall panel assembly comprising the steps of:

forming a wall frame including a lower generally horizontal member;

providing a base rail;

providing a pair of glide assemblies;

operatively connecting said glide assemblies to said base rail and said lower member of said wall frame, said glide assemblies each including a generally vertically oriented adjustment member;

providing a pair of apertures in said lower member of said wall frame, each aperture vertically aligned above an adjustment member, said aperture having an axis disposed parallel to an axis of said adjustment member;

inserting a rotary tool vertically through said apertures to engage said adjustment members; and rotating said adjustment members with said rotary tool.

8. A modular panel assembly comprising:

a frame having a lower member having opposite end portions;

a rail positioned below said lower member and extending parallel thereto, said rail having opposite end portions; first and second structures attached to said rail and to said lower member for connecting said frame at a distance from said rail, and each of said first and said second structures including a threaded portion having a longitudinal central axis extending in a vertical direction;

a pair of vertically oriented threaded members, each threaded member being received by a corresponding threaded portion, each of said threaded members having a vertically oriented longitudinal axis and an upper end portion being structured and dimensioned for receiving a tool to cause rotation of said threaded member around said longitudinal axis; and a pair of horizontally disposed apertures in said lower member structured and dimensioned to allow passage of a vertically oriented tool to enable said tool to make operative engagement with said upper end portion of said threaded member.

9. The modular panel assembly as claimed in claim 8 wherein:

each of said first and said second structures is attached to an end portion of said rail and an end portion of said lower member.

10. The modular panel assembly as claimed in claim 8 wherein:

said lower member includes vertically disposed side walls about said aperture.

11. The modular panel assembly as claimed in claim 10 wherein:

said lower member includes vertically disposed apertures in said side walls structured and dimensioned to receive snap-fit fasteners.

12. The modular panel assembly as claimed in claim 8 wherein:

said rail includes a pair of apertures for receiving said threaded members.

13. The modular panel assembly as claimed in claim 8 wherein:

each of said first and said second structures connects to a kick plate.

14. The modular panel assembly as claimed in claim 8 wherein:

said upper end portion of each of said threaded members has the form of a hex head.

15. The modular panel assembly as claimed in claim 9 wherein:

said rail includes a pair of apertures for receiving said threaded members.

16. The modular panel assembly as claimed in claim 15 wherein:

said lower member includes vertically disposed side walls about said aperture; and said lower member includes vertically disposed apertures in said side walls structured and dimensioned to receive snap-fit fasteners.

17. The modular panel assembly as claimed in claim 16 wherein:

each of said first and said second structures connects to a kick plate; and said upper end portion of each of said threaded members has the form of a hex head.

18. A method for constructing and installing a modular wall panel assembly comprising the steps of:

providing a generally rectangular frame, said frame having a lower member;

providing a base rail;

providing a pair of support structures;

attaching said pair of support structures to said lower member and to said rail such that said rail is generally parallel to and spaced from said lower member with said lower member being at a higher elevation than said rail;

said support structures each including a threaded portion aligned to have a longitudinal axis in a vertical direction;

said lower member having horizontally disposed apertures aligned such that said longitudinal axis of each threaded portion passes through a corresponding aperture;

providing a pair of threaded members having upper ends structured and dimensioned to receive a tool;

rotating said threaded members into said threaded portions;

placing said frame, rail and support structures in a vertical orientation on a floor;

inserting a rotatable tool generally vertically through said apertures of said lower member in general alignment with said longitudinal axes of said threaded portions and engaging said upper ends of said threaded members; and rotating said tool and said threaded members to horizontally level said frame in relation to said floor.

19. The method as claimed in claim 18 including the step of:

attaching said support structures to end portions of said lower member and said rail.

* * * * *